United States Patent [19]

Stanley et al.

[11] 3,967,671

[45] July 6, 1976

[54] UPWARDLY-ACTING SECTIONAL DOOR

[76] Inventors: Ralph W. Stanley, 30 Sutherland Road, North Attleboro, Mass. 02760; Norman G. Compton, 856A Oakridge Ave., North Attleboro, Mass. 02760; Lionel J. Bibeault, Eaton St., Cumberland, R.I. 02864

[22] Filed: Jan. 6, 1975

[21] Appl. No.: 538,598

[52] U.S. Cl. ..... 160/232; 160/201; 49/501

[51] Int. Cl.[2] ..... E06B 3/16; E06B 3/48

[58] Field of Search ..... 160/232, 230, 229 R, 160/234, 235, 236, 133, 206, 201; 49/501, 503, 504

[56] References Cited

UNITED STATES PATENTS

| | | | |
|---|---|---|---|
| 2,907,383 | 10/1959 | Kloote et al. | 160/232 X |
| 2,924,861 | 2/1960 | Viets | 49/503 X |
| 3,104,699 | 9/1963 | Wolf et al. | 160/232 X |
| 3,287,856 | 11/1966 | Passovoy | 49/504 |
| 3,479,784 | 11/1969 | Massagli | 160/235 X |
| 3,511,301 | 5/1970 | Graham | 160/232 UX |

FOREIGN PATENTS OR APPLICATIONS

| | | | |
|---|---|---|---|
| 1,155,897 | 10/1963 | Germany | 160/232 |

*Primary Examiner*—Philip C. Kannan
*Attorney, Agent, or Firm*—Barlow & Barlow

[57] ABSTRACT

An upwardly-acting sectional door composed of a plurality of sections for sliding from a vertical track which aligns the sections in a vertical plane around a curved track to a horizontal track which aligns the sections in a horizontal plane. The sections are hinged together and each section is substantially the same throughout its width or length so that it may be cut off to provide any width door. The sections comprise an extruded or formed foamlike light material of a good heat insulating property which is reinforced at the location that the hinges are placed, and each section has interfitting edges. The sections are finished by face pieces of stiff material that may be adhesively secured to the foam or made integral therewith.

4 Claims, 8 Drawing Figures

UPWARDLY-ACTING SECTIONAL DOOR

BACKGROUND OF THE INVENTION

In the past it has been customary to manufacture garage door sections in standard lengths of 8, 10, 12, 14 and 16 feet and of a variety of widths. In some steel construction it is, for example, customary to find an opening of two inches in excess of a standard eight-foot opening, requiring special sections to be made up. It is also desirable to provide a lightweight door consistent with proper insulating properties; for example, in high openings required for commercial trucks, the weight of the door is considerable. There have been some proposals to provide lightweight doors, as in the Stroup U.S. Pat. No. 2,880,796, but this construction requires special and expensive metallic edge extrusions. Similarly, another lightweight door is shown in Kloote et al. U.S. Pat. No. 2,907,383, but here there is no proper provision for the mounting of the necessary door hardware that will survive rough service, plugs in the weak plastic-filled portion being utilized. The present invention overcomes these prior art weaknesses and provides a door section that can be made in a long length and cut for each installation.

SUMMARY OF THE INVENTION

The invention is intended for an upwardly-acting sectional door, more particularly an overhead door for a garage or the like, in which there are channel guides or tracks at the edges of the door which extend vertically and then curve around to direct the door horizontally overhead. The sections in order to make the curve from vertical to horizontal are relatively narrow in comparison with their width or length and each section is an extruded foamlike material with skin faces and along the portions where the hinges are to attach one section to the other the sections are reinforced usually with some sort of metal. The skins may be conveniently formed of some resin which is reinforced with fiberglass and theoretically may be of indefinite lengths and cut off for whatever width door is desired. The sections may be tongued and grooved or fashioned for fitting together and these tongues and grooves may be formed of some closure means of a reinforcing nature.

DESCRIPTION OF THE PREFERRED EMBODIMENTS

Figure 1:
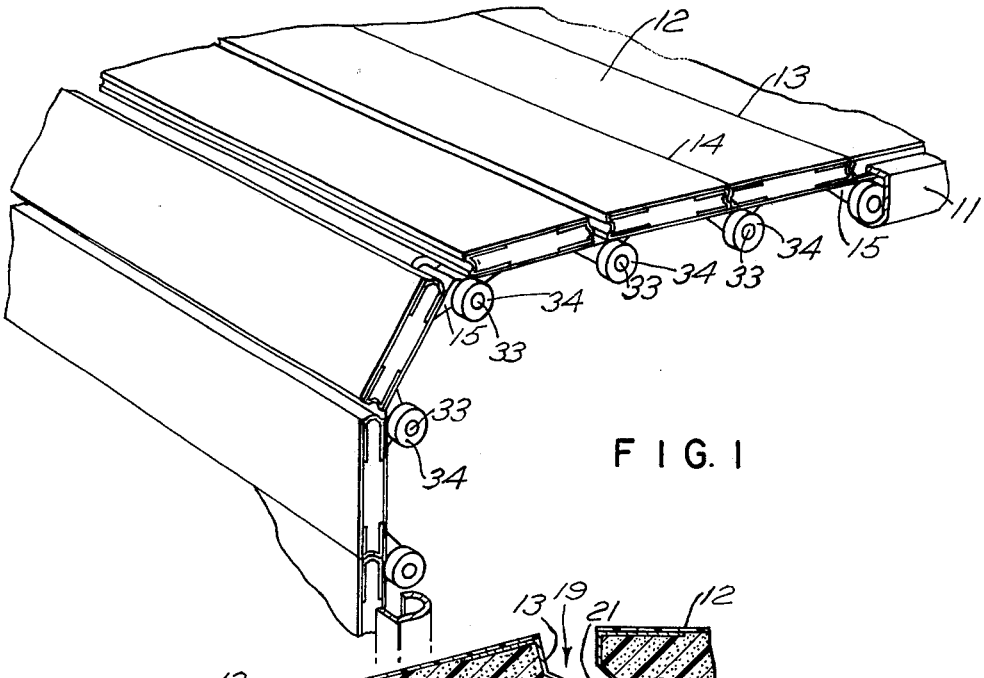
FIG. 1 is a perspective fragmental view of a plurality of sections hinged together showing their relationship for movement from a vertical to a horizontal overhead position and showing portions of the channels in which they slide, the near channel being broken away to better show the construction of the hinging action.
Figure 2:
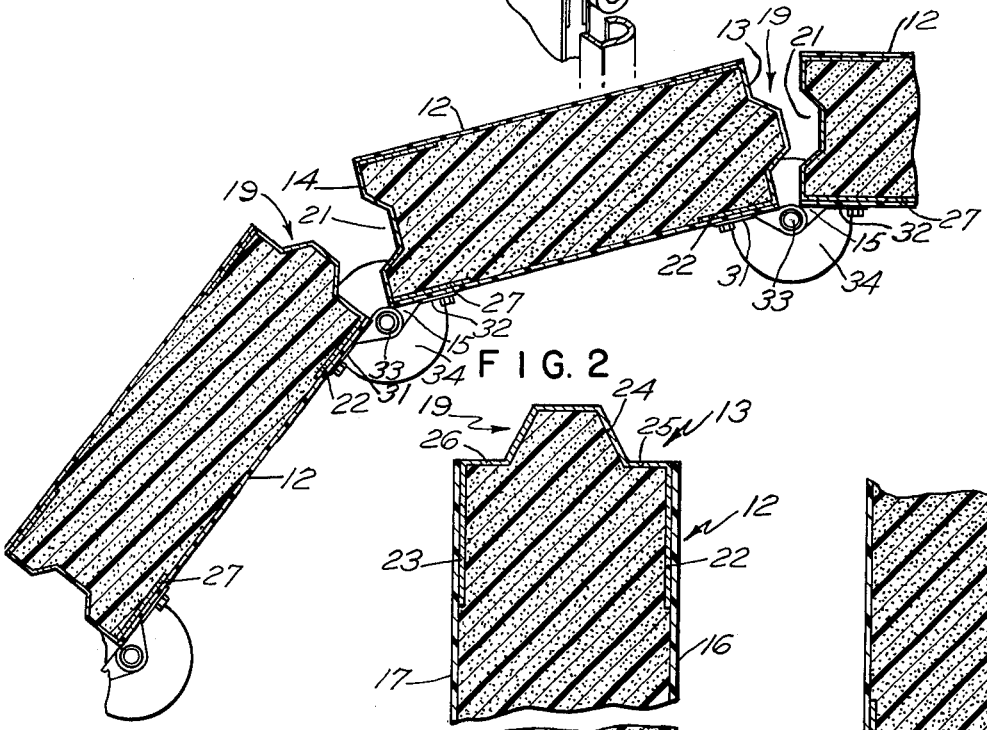
FIG. 2 is a sectional view showing the hinged relationship at the curve of the sections in moving from a vertical to a horizontal position with the rolls omitted.

With reference to the drawings and particularly FIG. 1, the sectional door is guided in a pair of opposed tracks 11, only one being shown, the near channel being broken away to show the edge of the door. The door comprises a plurality of sections 12, each of which may be extruded or suitably cut into a slab which is reinforced at its opposite edges 13 and 14 by some sort of strengthening material such as metal, and along these reinforced portions hinges 15 are attached at such spaced intervals as may be required for proper support of the sections one from the other in the upwardly-acting door and the end hinge is a holder for rollers as well known in the art.

Figure 3:
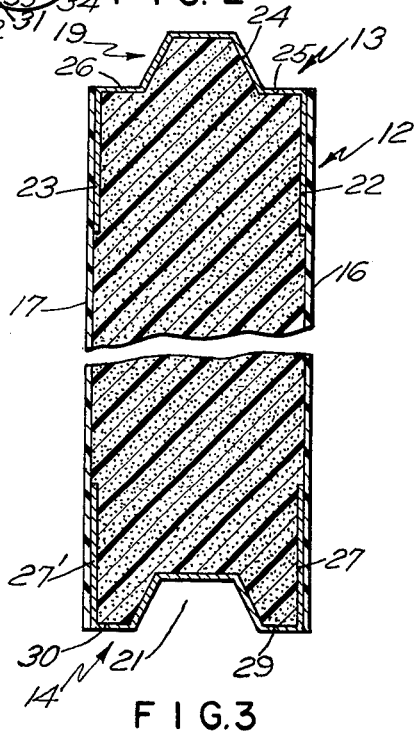
FIG. 3 is a sectional view on a larger scale showing one of the sections.

In FIG. 3 the section is extruded or formed in a shape to provide a tongue 19 and a mating groove 21 and is faced with skins 16 and 17 such as a resin reinforced fiberglass. The section is reinforced at its upper edge 13 by a one-piece roll-formed piece having flat metal plates 22, 23 on each face which plates are joined by an end 24 that forms the tongue 19 with flanges 25 and 26 at its sides that are continuations of the reinforcing plates 22 and 23. At the lower edge of the section there is a similar roll-formed piece having a flat plate 27 along the inner face skin 16 which has a groove portion 21 flanged as at 29 and 30 to extend along the corresponding shape of the connecting end of the skin as shown in FIG. 3 and a outer face skin plate 27'.

The hinge 15 is joined to adjacent sections by reason of a portion of the hinge 31 being attached to the section at the location of the reinforcing plate 22 while another portion of the hinge 32 is connected along the reinforcing portion of the adjacent section at the location of the reinforcing plate 27. A pintle 33 permits the swinging of the two sections on the hinge connections as may be desired and on this hinge pintle there is a wheel such as 34 which rolls in the channels such as 11 as the case may be on one side or the other of the door as it is moved from a vertical position to an overhead horizontal position. As the sections come into the same plane the tongue 19 will lodge in the recess or groove 21 of the adjacent section providing a substantially tight joint.

The sections 12 of this described formation have a core of foam plastic which is of a light material whereas the skins are of relatively dense material. This foam provides good insulating and soundproofing qualities. Alternately, the section may be molded of structural foam plastic in which case the skins 16 and 17 would be an integral formation with the core.

Figure 4:
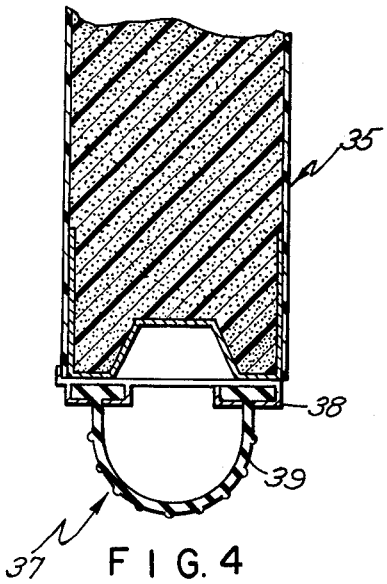
FIG. 4 is a fragmental view of the lower section showing a sealing means for the lower edge of the door.

The lower section, designated 35 in FIG. 4, may be provided with a weatherseal assembly 37 which has an extrusion 38 holding a rubber bulbousshape portion 39 which will be somewhat compressed as it hits the floor of the opening that the door closes so as to seal the same along its bottom edge.

Figure 5:
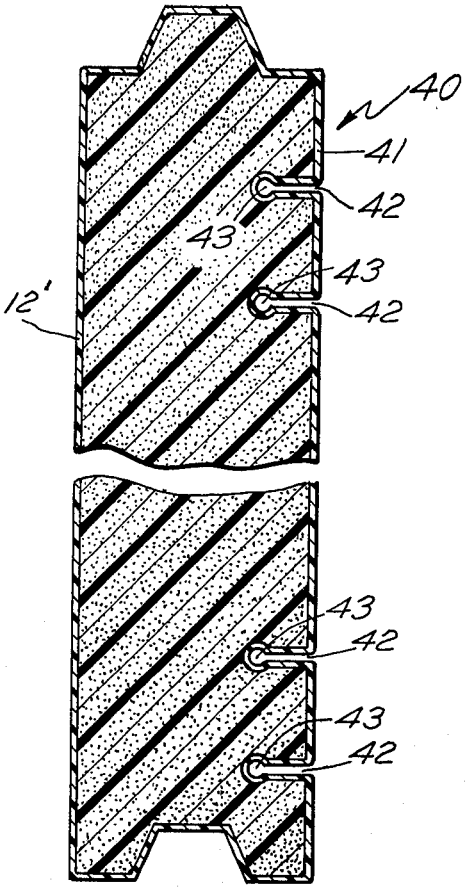
FIG. 5 is a sectional view of a modified extrusion showing a different means for attaching hinges in position.

In FIG. 5 a modified form of section designated 40 is provided with a face 12' corresponding to the face 12, and the opposing face which is now designated 41, is provided with a plurality of recesses 42 having enlarged portions 43 for the reception of the lag bolt screws screwed into the recesses and then nuts may be used to secure hinges thereto. These recesses or longitudinal grooves act as a reinforcing means for the skin 41.

Figure 6:
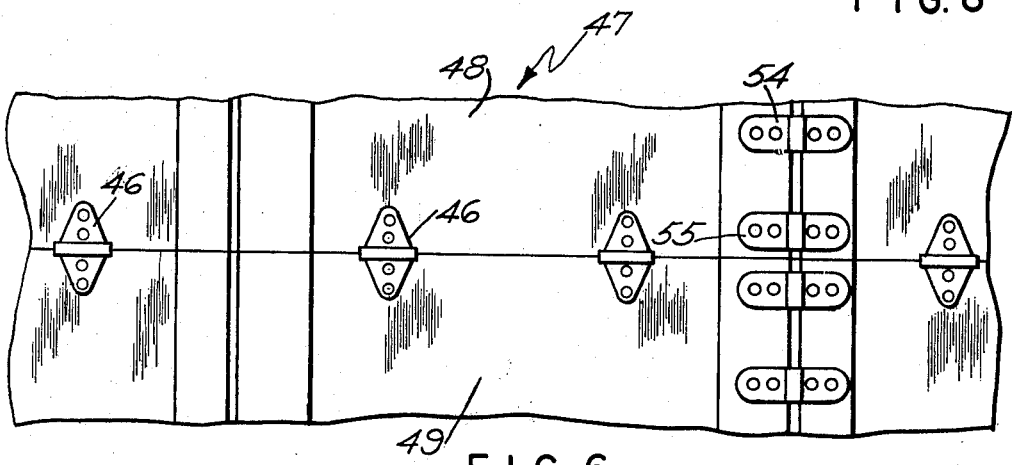
FIG. 6 is an elevation of a portion of the inside face of a door in which there is formed a pass through door.
Figure 7:
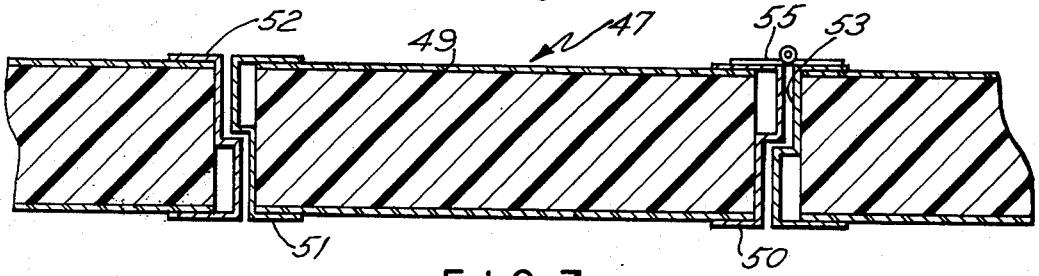
FIG. 7 is a sectional view looking at the bottom of the door as shown in FIG. 6.

In some cases it is desired to provide a pass-through door which nominally are cut three or four sections high. Referring to FIGS. 6 and 7, the sections hinge together as heretofore as at 46, and are provided with a cutout portion generally designated 47. This portion illustrated, by way of example, as two adjacent cutout sections 48 and 49 are provided with edge extrusions 50, 51, along each end which mate with similarly formed extrusions 52, 53 affixed to the panels 48, 49 and so forth. The sections are hinged together as at 54, 55, and so forth, so as to swing at right angles to the hinging of the main sections 48, 49 and so forth. Similar techniques with glazing hardware and extrusions may be used to provide lites.

Figure 8:
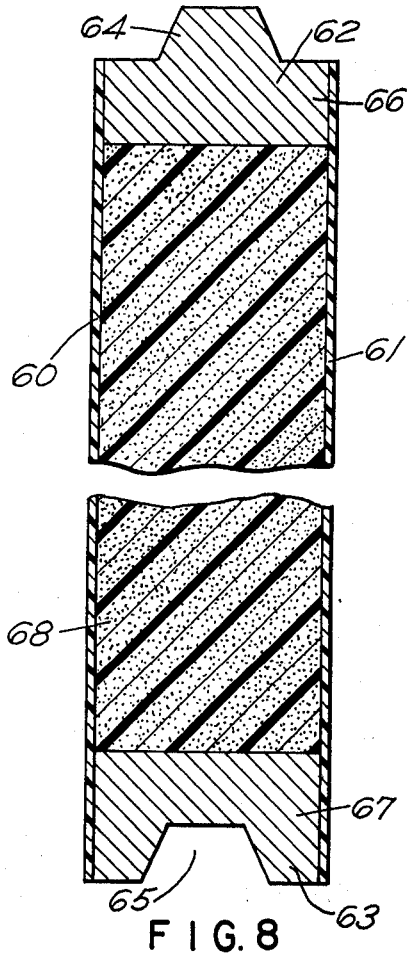
FIG. 8 is a sectional view of a still further modified form of section illustrating solid end closures for the section.

In FIG. 8 there is illustrated a section as formed of opposite face skins 60 and 61 which are secured to solid end pieces 62 and 63 of metal, plastic or wood, one providing a tongue as at 64 and another a recess as at 65, and at the same time providing reinforcing means as at 66 and 67 for the attaching of hinges to the sections for their movement one relative to the other. The area 68 will be filled with foam as heretofore indicated. By the above arrangement of relatively dense skins and relatively light foamed filling as a reinforcing for the skins, the hinging means may be well reinforced by some sort of a metal strip along the edges where the hinges are secured and a relatively light door may be provided using standard hardware. In view of the fact that the skins and the reinforcing means extend substantially the entire length of the skins, the section is uniform throughout its length and may be cut off at any point for accommodation of a door of any width in its use. Further, it will be apparent that the cut ends may be easily preserved with protective coatings, for example, epoxy paints that inhibit the entry of moisture and other foreign matter.

We claim:

1. An upwardly-acting sectional door or the like comprising a plurality of elongated horizontally extending sections in edge to edge adjacency, each section comprising opposite sheet material face skins of a relatively dense material over substantially the entire area of the section faces with a filling of a relatively porous material between said skins, edge closure means between said skins at the edge of each section, the closure means being formed to define a tongue at one edge and a mating groove at the other, continuous reinforcing means adjacent the opposite longitudinal edges of at least one of said skins and in contact with the skin over a substantial width thereof, said closure means and reinforcing means being of the same piece of material and hinge means contacting the face of the skin at opposite edges of said section at the location of said reinforcing means for hingedly connecting the longitudinal edge portions of adjacent sections, and means passing through said hinge means, said skin and into said reinforcing means to attach said hinge means to the face of said section.

2. An upwardly-acting sectional door or the like as in claim 1 wherein the edge closure means and skins are one piece and of the same material and the reinforcing means comprises formed longitudinal grooves with a bulbous end wall in the face of one skin.

3. An upwardly-acting sectional door or the like as in claim 1 wherein the edge closure means and skins are of different materials.

4. An upwardly-acting sectional door or the like as in claim 1 wherein the skins are a fiberglass reinforced resin and the reinforcing means is of metal.

* * * * *